US009425514B2

(12) United States Patent
Chou

(10) Patent No.: US 9,425,514 B2
(45) Date of Patent: Aug. 23, 2016

(54) WIDEBAND ANTENNA

(71) Applicant: Wistron Corporation, New Taipei (TW)
(72) Inventor: Chen-Yu Chou, New Taipei (TW)
(73) Assignee: Wistron Corporation, New Taipei (TW)

( * ) Notice: Subject to any disclaimer, the term of this patent is extended or adjusted under 35 U.S.C. 154(b) by 142 days.

(21) Appl. No.: 14/260,288
(22) Filed: Apr. 24, 2014
(65) Prior Publication Data
US 2015/0188235 A1 Jul. 2, 2015
(30) Foreign Application Priority Data
Jan. 2, 2014 (TW) ..... 103100056 A
(51) Int. Cl.
*H01Q 13/10* (2006.01)
*H01Q 19/185* (2006.01)
*H01Q 11/06* (2006.01)
(52) U.S. Cl.
CPC ..... *H01Q 19/185* (2013.01); *H01Q 11/06* (2013.01)
(58) Field of Classification Search
CPC ..... H01Q 1/38; H01Q 5/55; H01Q 5/28; H01Q 13/085; H01Q 9/285; H01Q 9/28; H01Q 21/06; H01Q 9/16; H01Q 13/10
USPC ..... 343/700 MS, 795, 807, 825, 828, 829, 343/830, 846, 767, 770
See application file for complete search history.

(56) References Cited

U.S. PATENT DOCUMENTS 4,001,834 A * 1/1977 Smith ..... H01Q 13/08 333/238
5,539,414 A * 7/1996 Keen ..... H01Q 1/243 343/700 MS
6,239,765 B1 * 5/2001 Johnson ..... H01Q 1/243 343/702
6,861,990 B2 * 3/2005 Hung ..... H01Q 1/38 343/702
7,012,573 B2 * 3/2006 Tchistiakov ..... H01Q 1/38 343/795
7,053,852 B2 * 5/2006 Timofeev ..... H01Q 1/246 343/793
7,173,566 B2 * 2/2007 Cheng ..... H01Q 1/38 343/700 MS (Continued)

OTHER PUBLICATIONS

"Office Action of Taiwan Counterpart Application", issued on Apr. 21, 2016, with English translation thereof, p. 1-p. 12.

*Primary Examiner* — Dameon E Levi
*Assistant Examiner* — Awat Salih
(74) *Attorney, Agent, or Firm* — Jianq Chyun IP Office

(57) ABSTRACT

A wideband antenna includes a radiation element, first and second extension elements, first and second reflection elements, and a feeding element. The radiation element is symmetric to a reference direction and has a top edge, a bottom edge, a first side edge, and a second side edge. A width of the radiation element gradually increases along the reference direction. The first and second extension elements are extended toward the reference direction respectively from two ends of the top edge and are mirror-symmetric to each other with respect to the reference direction. Widths of the first and second extension elements gradually decrease along the reference direction. The first and second reflection elements are respectively opposite to the first and second side edges and are mirror-symmetric to each other with respect to the reference direction. The feeding element is electrically connected to the bottom edge and has a feeding point.

15 Claims, 7 Drawing Sheets

(56) References Cited

U.S. PATENT DOCUMENTS 7,295,162 B2 * 11/2007 Wang ..... H01Q 1/007 343/700 MS
7,592,966 B2 * 9/2009 Tsai ..... H01Q 9/28 343/795
7,786,947 B2 * 8/2010 Bae ..... H01Q 1/38 343/700 MS
2012/0119954 A1 * 5/2012 Chen ..... H01Q 9/0435 343/700 MS
2013/0038495 A1 * 2/2013 Benzel ..... H01Q 21/08 343/770

* cited by examiner

WIDEBAND ANTENNA

CROSS-REFERENCE TO RELATED APPLICATION

This application claims the priority benefit of Taiwan application serial no. 103100056, filed on Jan. 2, 2014. The entirety of the above-mentioned patent application is hereby incorporated by reference herein and made a part of this specification.

BACKGROUND OF THE INVENTION

1. Field of the Invention

The invention relates to an antenna and more particularly to a wideband antenna.

2. Description of Related Art

With the development of mobile communication devices with multi-functions and characterized by miniaturization, a newly developed antenna (i.e., antenna under test, AUT) must pass verification tests and product certification tests in a short-range test environment, so as to ensure that the radiation pattern of the antenna meets the application requirements of the mobile communication devices. The AUT is placed in a small shield room in the short-range test environment, and a calibration antenna in the shield room is used in the verification test or product certification test for the AUT.

In general, because the horn antenna is characterized by its wide bandwidth, most of the existing shield rooms employ the horn antenna as the calibration antenna of the AUT in the verification test and the product certification test. However, the horn antenna is often so large and thus may not be applied in the small shield rooms. Therefore, how to design a wideband antenna within a limited space as a calibration antenna applied in the small shield rooms is one of the major issues occurring in the verification test and the product certification.

SUMMARY

One of exemplary embodiments provides a wideband antenna characterized by its wideband and its advantages of miniaturization. Therefore, the wideband antenna may be used as the calibration antenna in small shield rooms and applied to various kinds of mobile communication devices.

In an exemplary embodiment, a wideband antenna includes a radiation element, a first extension element and a second extension element, a first reflection element and a second reflection element, and a feeding element. The radiation element is symmetric to a reference direction and has a top edge, a bottom edge, a first side edge, and a second side edge. A width of the radiation element increases along the reference direction. The first extension element and the second extension element are extended toward the reference direction respectively from two ends of the top edge and are mirror-symmetric to each other with respect to the reference direction. Widths of the first and second extension elements decrease along the reference direction. The first and second reflection elements are respectively opposite to the first and second side edges and are mirror-symmetric to each other with respect to the reference direction. The feeding element connected to the bottom edge has a feeding point.

Based on the above, according to an exemplary embodiment, the width of the radiation element in the wideband antenna increases along the reference direction, and the widths of the two extension elements extending from the top edge of the radiation element decrease along the reference direction. Furthermore, the two reflection elements are respectively disposed on both sides of the radiation element. Thereby, the wideband antenna provided herein and characterized by its wideband and the advantages of miniaturization may serve as the calibration antenna in the small shield rooms and may be applied to various kinds of mobile communication devices.

Several exemplary embodiments accompanied with figures are described in detail below to further describe the invention in details.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the invention.

DETAILED DESCRIPTION OF DISCLOSED EMBODIMENTS

Figure 1:
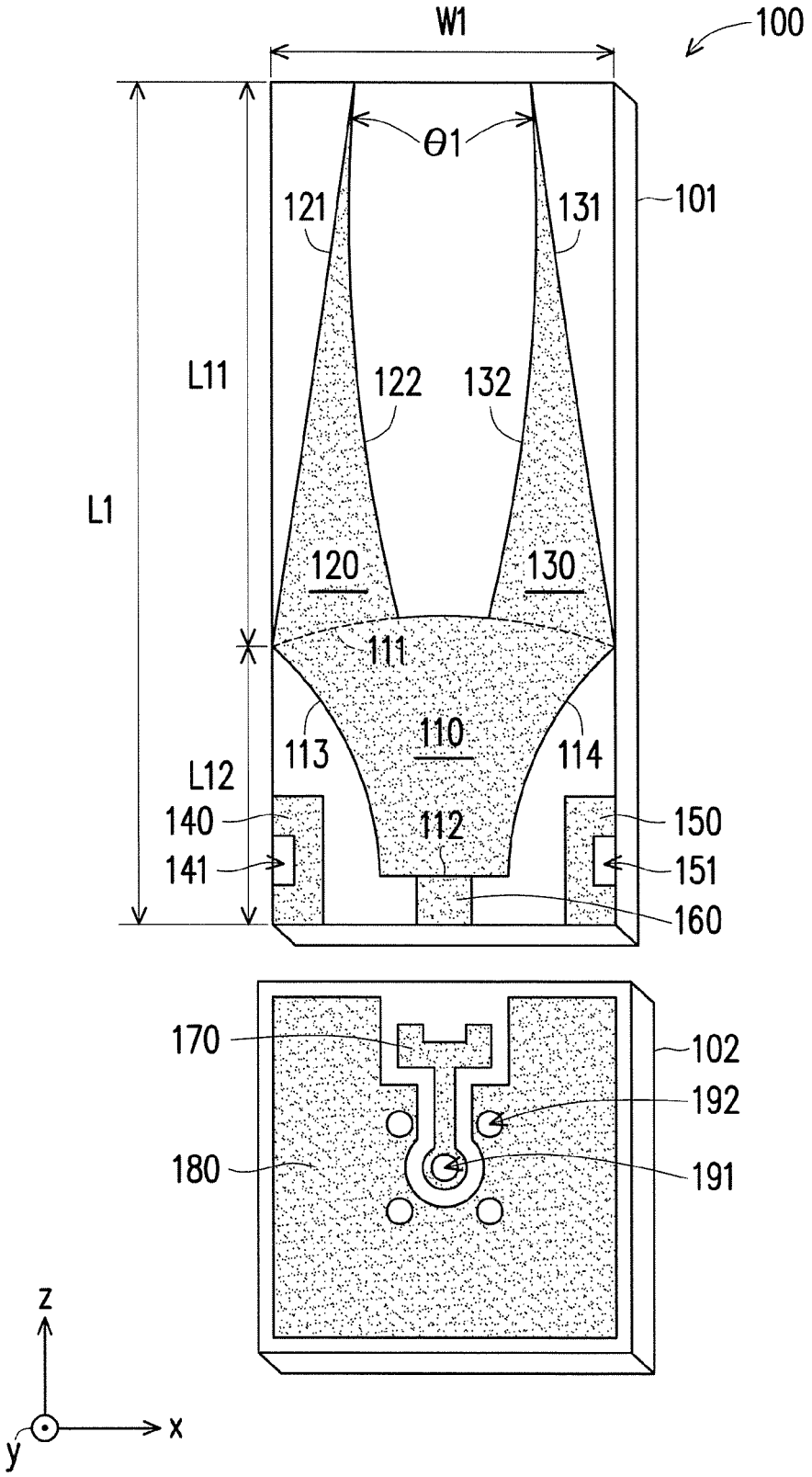
FIG. 1 is a schematic diagram illustrating a structure of a wideband antenna according to an exemplary embodiment.

FIG. 1 is a schematic diagram illustrating a structure of a wideband antenna according to an exemplary embodiment. As shown in FIG. 1, the wideband antenna 100 includes a radiation element 110, a first extension element 120, a second extension element 130, a first reflection element 140, a second reflection elements 150, and a feeding element 160, wherein the radiation element 110 is symmetric to a reference direction, for example, the z-axis direction. The radiation element 110 has a top edge 111, a bottom edge 112, a first side edge 113, and a second side edge 114.

The top edge 111 of the radiation element 110 is opposite to the bottom edge 112, and the first side edge 113 of the radiation element 110 is opposite to the second side edge 114. In addition, the first side edge 113 and the second side edge 114 define the width of the radiation element 110. For example, plural distances between the first side edge 113 and the second side edge 114 in the z-axis direction define the width of the radiation element 110. Furthermore, the width of the radiation element increases along the reference direction (i.e., the z-axis direction), and the first side edge 113 and the second side edge 114 are inwardly concave. Therefore, the first side edge 113 and the second side edge 114 have an arc shape, respectively, and the radiation element 110 has a fan-like shape.

The first extension element 120 and the second extension element 130 extend toward the reference direction (i.e., the z-axis direction) respectively from two ends of the top edge 111 of the radiation element 110, and the first extension element 120 and the second extension element 130 are mirror-symmetric to each other with respect to the reference direction (i.e., the z-axis direction). In other words, the first extension element 120 and the second extension element 130 have substantially the same shape.

For example, the first extension element 120 has a first bevel edge 121 and a second bevel edge 122, and the first bevel edge 121 and the second bevel edge 122 intersect with each other and define the width of the first extension element 120. For instance, plural distances between the first bevel edge 121 and the second bevel edge 122 in the x-axis direction are the width of the first extension element 120. Similarly, the second extension element 130 has a third bevel edge 131 and a fourth bevel edge 132, and the third bevel edge 131 and the fourth bevel edge 132 intersect with each other and define the width of the second extension element 130. For instance, plural distances between the third bevel edge 131 and the fourth bevel edge 132 in the x-axis direction are the width of the second extension element 130.

Furthermore, the widths of the first extension element 120 and the second extension element 130 decrease along the reference direction (i.e., the z-axis direction). In addition, the first bevel edge 121 of the first extension element 120 and the third bevel edge 131 of the second extension element 130 have a linear shape, and the second bevel edge 122 of the first extension element 120 and the fourth bevel edge 132 of the second extension element 130 have an arc shape. Besides, an intersection of an extension direction of the second bevel edge 122 and an extension direction of the fourth bevel edge 132 forms an angle θ1, and said angle θ1 may be 17 degrees, for example.

The first reflection element 140 is opposite to the first edge 113 of the radiation element 110. The second reflection element 150 is opposite to the second side edge 114 of the radiation element 110. In addition, the first reflection element 140 and the second reflection element 150 are mirror-symmetric to each other with respect to the reference direction (i.e., the z-axis direction). In other words, the first reflection element 140 and the second reflection element 150 have substantially the same shape. For example, the first reflection element 140 has a notch 141, and an opening of the notch 141 faces away from the first side edge 113 of the radiation element 110. Similarly, the second reflection element 150 has a notch 151, and an opening of the notch 151 faces away from the second side edge 114 of the radiation element 110.

From another point of view, the first reflection element 140 and the second reflection element 150 in FIG. 1 are roughly shaped as the letter C. Although the exemplary embodiment depicted in FIG. 1 demonstrates several ways to implement the first reflection element 140 and the second reflection element 150, the invention is not limited thereto, and those having ordinary skill in the art may make various modifications and variations to the shape of the first reflection element 140 and the second reflection element 150 based on actual design requirements, for instance, the first reflection element 140 and the second reflection element 150 may respectively have a rectangular shape, a square shape, an elliptical shape, or any geometric shape.

The feeding element 160 is electrically connected to the bottom edge 112 of the radiation element 110 and has a feeding point. In addition, the wideband antenna 100 is a monopole antenna substantially. In teems of operation, the wideband antenna 100 receives a feeding signal through the feeding element 160. Through the excitation of the feeding signal, the wideband antenna 100 generates a resonant mode through a plurality of current paths formed by the radiation element 110 and then is operated in the first band (e.g., the middle frequency band). Additionally, the wideband antenna 100 extends a part of the current paths in the radiation element 110 through the first extension element 120 and the second extension element 130 so as to be operated in the second band (e.g., the low frequency band). Moreover, the wideband antenna 100 can be operated in the third band (i.e., the high frequency band) through a second harmonic in the resonant mode.

Figure 2:
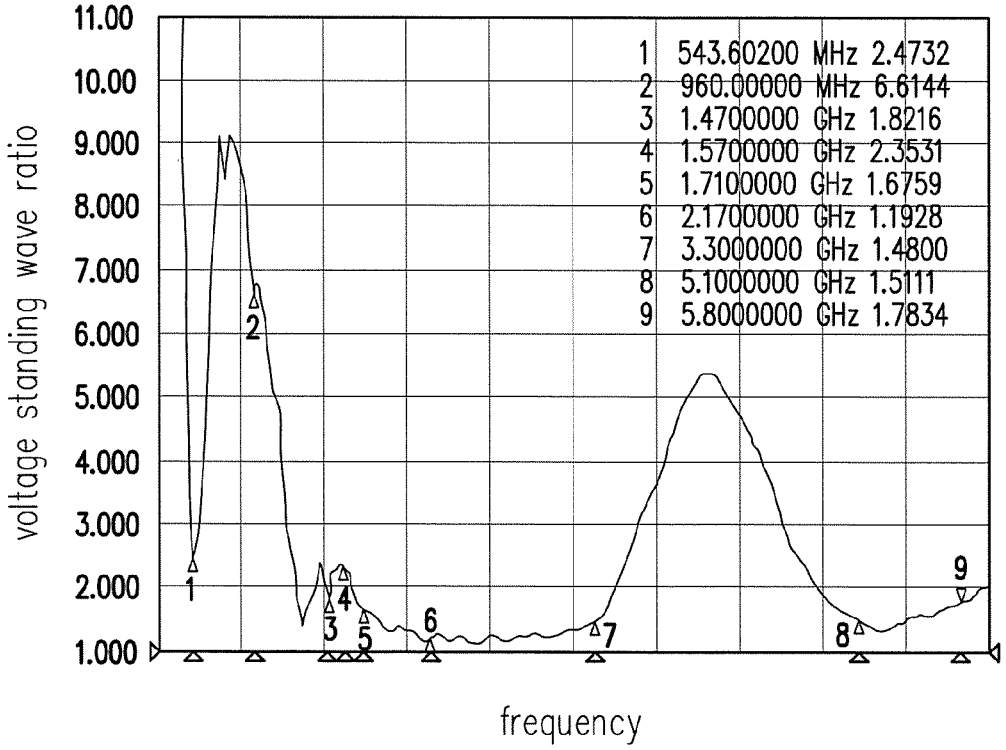
FIG. 2 illustrates a voltage standing wave ratio (VSWR) figure of a wideband antenna according to an exemplary embodiment.
Figure 3:
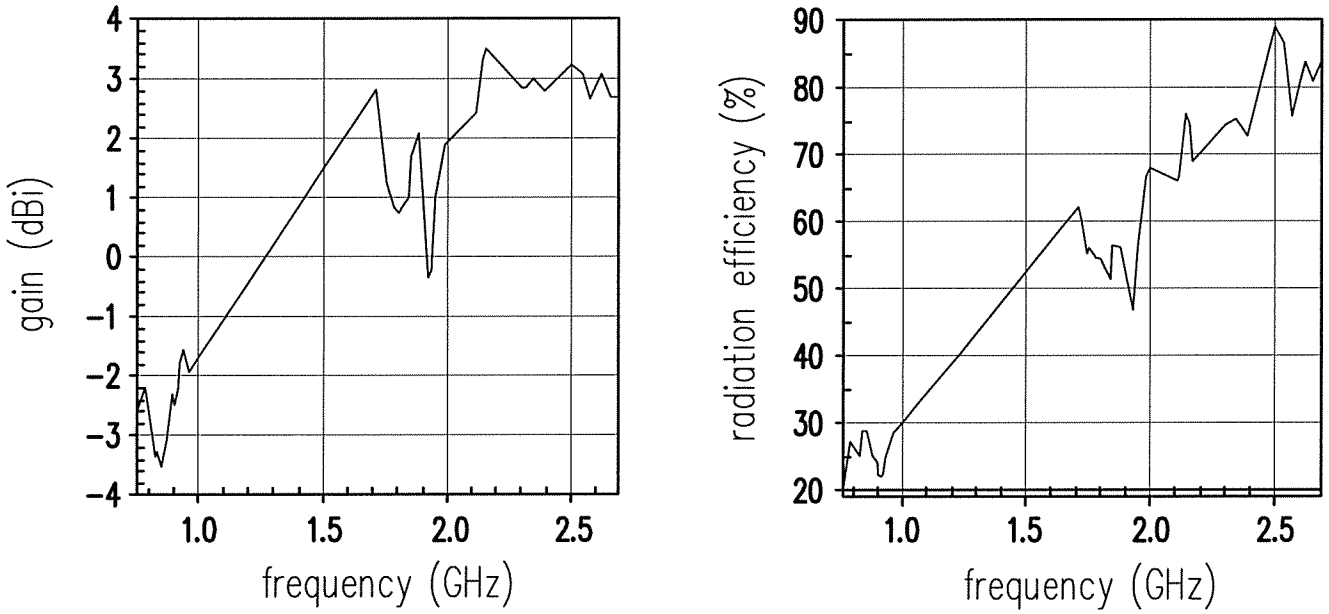
FIG. 3 and FIG. 4 are diagrams of gain and radiation efficiency of a wideband antenna according to an exemplary embodiment.
Figure 4:
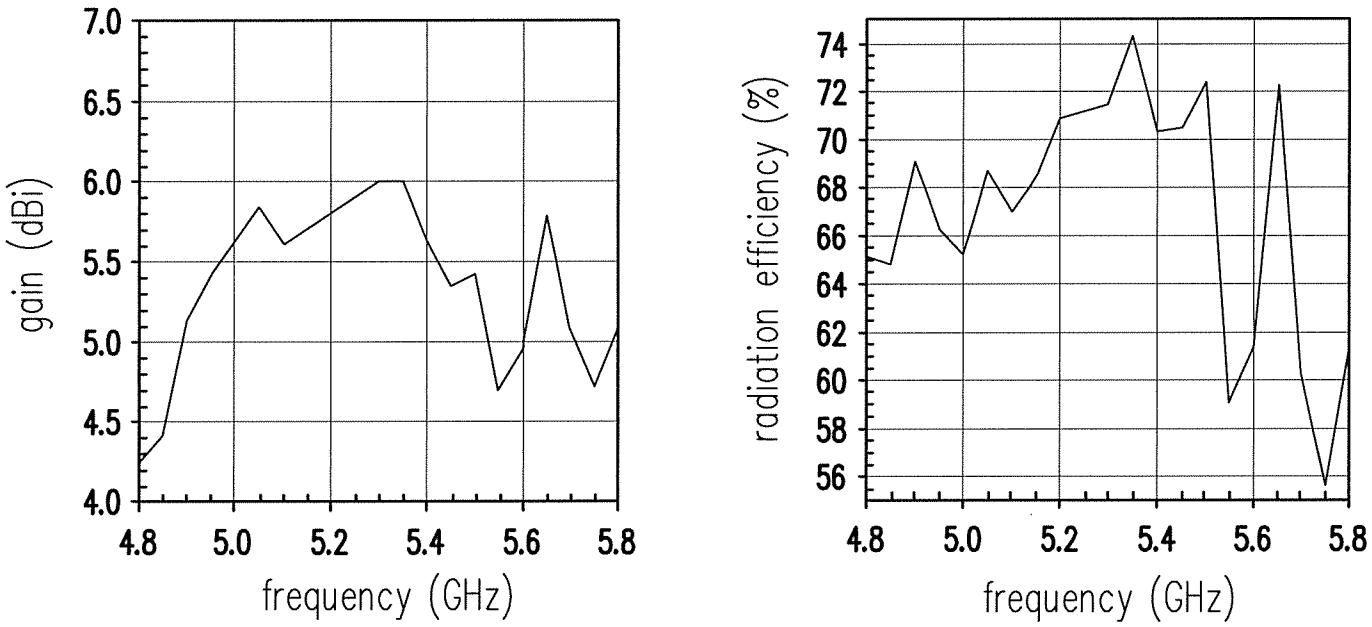

For example, FIG. 2 illustrates a voltage standing wave ratio (VSWR) figure of a wideband antenna according to an exemplary embodiment. As shown in FIG. 2, the first band (e.g., the middle frequency band) of the wideband antenna 100 is, for instance, from 1.5 GHz to 3.6 GHz; thereby, the wideband antenna 100 may be operated in the GPS/GSM/LTE bands. Furthermore, the second band (i.e., the low frequency band) of the wideband antenna 100 is, for instance, from 500 MHz to 960 MHz, and the third frequency (i.e., the high frequency band) is, for instance, from 4.8 GHz to 5.8 GHz; thereby, the wideband antenna 100 may be operated in the 802.11a band. Furthermore, FIG. 3 and FIG. 4 are diagrams of gain and radiation efficiency of a wideband antenna according to an exemplary embodiment. FIG. 3 and FIG. 4 both show that the wideband antenna 100 has great performance on low, middle, and high frequency bands.

In other words, the operating band of the wideband antenna 100 may be widely applied to cover various application bands, and the wideband antenna 100 has good performance on each band. Furthermore, the wideband antenna 100 not only has the characteristics of wideband but also has the advantages of miniaturization in structure. Therefore, the wideband antenna 100 may be used as the calibration antenna in small shield rooms to test the radiation patterns of the AUT in various application bands. Specifically, the wideband antenna 100 may be placed on top or bottom of the AUT, thereby increasing the convenience of the verification test or the product certification test on AUT. Moreover, the wideband antenna 100 may be applied to various kinds of mobile communication devices.

Figure 5:
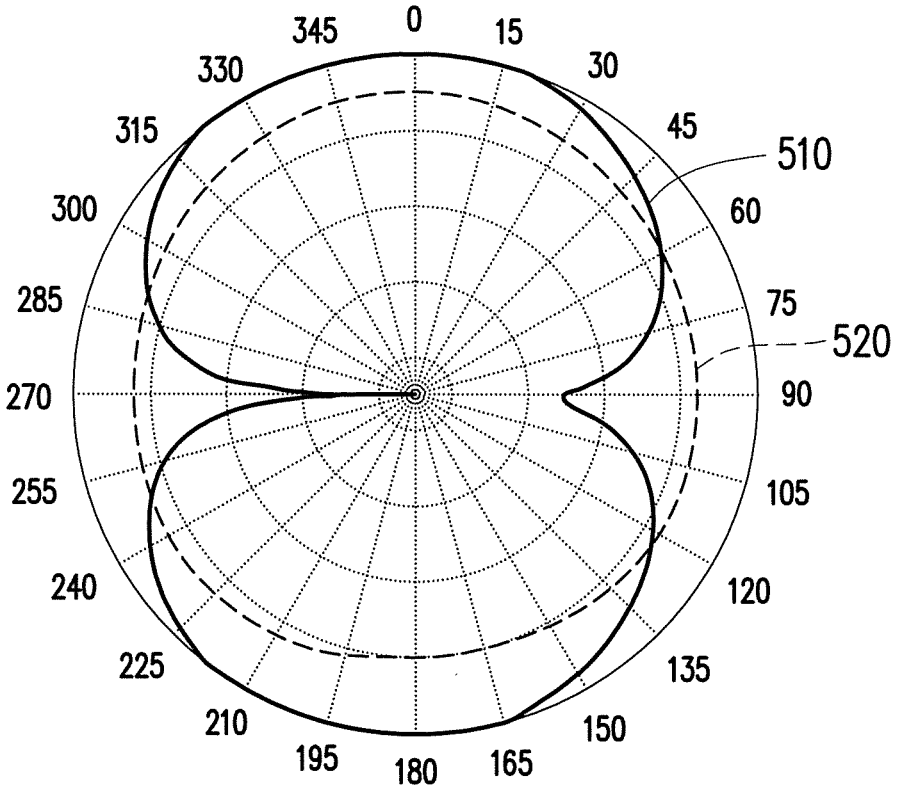
FIG. 5 is illustrates a radiation pattern of a wideband antenna according to an exemplary embodiment.

In addition, as shown in FIG. 1, the wideband antenna 100 may reflect or guide the radiated electromagnetic energy through the first reflection element 140 and the second reflection element 150. Thus, the radiated electromagnetic energy of the wideband antenna 100 on the first band (e.g., the middle frequency band) may leak out from the front side and back side of the wideband antenna 100, and thereby the wideband antenna 100 is equivalent to a wideband directional antenna. For example, FIG. 5 illustrates a radiation pattern of a wideband antenna according to an exemplary embodiment. According to the embodiment depicted in FIG. 5, the wideband antenna 100 is operated at 2.5 GHz, a curve 510 shows the radiation pattern of the wideband antenna 100 in the X-Z plane, and a curve 520 shows the radiation pattern of the wideband antenna 100 in the X-Y plane. As shown by the curve 510, the electromagnetic energy of the wideband antenna 100 may be focused on the front side and back side of the wideband antenna 100.

According to an exemplary embodiment, it is worth mentioning that a total width W1 of the wideband antenna 100 may be a quarter wavelength of the maximum frequency of the first band (e.g., 3.6 GHz), for example, and a total length L1 of the wideband antenna 100 may be a quarter wavelength of the minimum frequency of the first band (e.g., 1.5 GHz), for example. In addition, the wideband antenna 100 has a first length L11 and a second length L12 in the reference direction (e.g., the z-axis direction), if observed from one end of the top edge 111 of the radiation element 110 as a boundary, and the ratio of the first length L11 to the second length L12 is 2:1.

As shown in FIG. 1, the wideband antenna 100 further includes a first substrate 101 and a second substrate 102, wherein the radiation element 110, the first extension element 120, the second extension member 130, the first reflection element 140, the second reflection element 150, and the feeding element 160 are all located on one surface of the first substrate 101. Furthermore, the second substrate 102 is mainly served as a holder of the wideband antenna 100. Here, a signal line 170 and a ground plane 180 are located on one surface of the second substrate 102, and an antenna connector 190 (e.g., an SMA connector) is located on the other surface of the second substrate 102. In addition, a number of through-holes (e.g., through-holes 191 and 192) penetrate through the second substrate 102.

Figure 6:
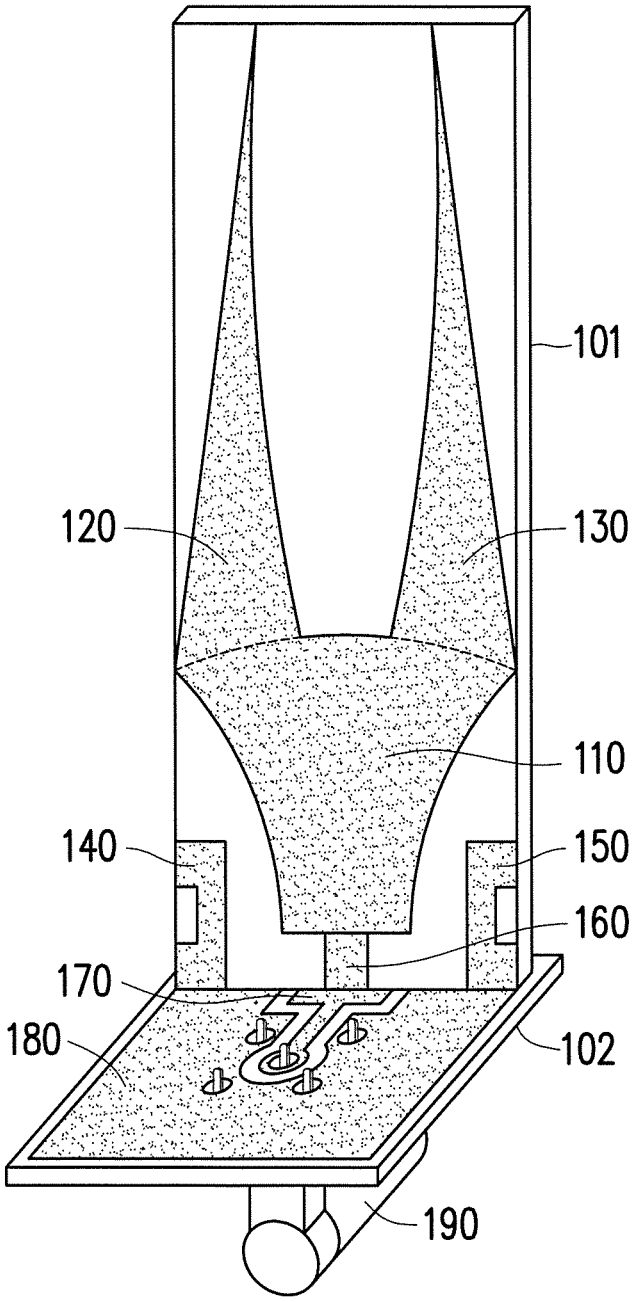
FIG. 6 is a schematic diagram illustrating a combination of components in a wideband antenna according to an exemplary embodiment.

Specifically, FIG. 6 is a schematic diagram illustrating a combination of components in a wideband antenna according to an exemplary embodiment. As shown in FIG. 6, the second substrate 102 is perpendicular to the first substrate 101. In addition, the signal pin of the antenna connector 190 is electrically connected to the signal line 170 through the through-hole 191, and a plurality of positioning pins of the antenna connector 190 are electrically connected to the ground plane 180 through at least one through-hole (e.g., the through-hole 192). On the other hand, the feeding element 160 is electrically connected to the signal line 170 on the second substrate 102. The first reflection element 140 and the second reflection element 150 are electrically connected to the ground plane 180 which is on the second substrate 102. Thus, the wideband antenna 100 may receive the feeding signals through the antenna connector 190 on the second substrate 102.

Although the embodiment shown in FIG. 6 discloses a way to combine the first substrate 101 and the second substrate 102, it should not be construed as a limitation to the invention. For example, in another embodiment, the second substrate 102 and the first substrate 101 are parallel to each other. In this case, the ground plane 180 on the second substrate 102 can improve the characteristics of the wideband antenna 100 operated in the second band (e.g., the low band).

Notably, in terms of operations, the first extension element 120 and the second element 130 of the wideband antenna 100 generate an inductance effect, respectively, and a capacitance effect is generated between the first extension element 120 and the second extension element 130. Furthermore, the inductance effect and the capacitance effect are determined by the shapes of the radiation element 110, the first extension element 120, and the second extension element 130. Therefore, the characteristic parameters of the wideband antenna 100, such as the bandwidth, the gain, the radiation efficiency, or the directivity, may be adjusted by changing the shapes of the radiation element 110, the first extension element 120, and the second extension element 130.

Figure 7:
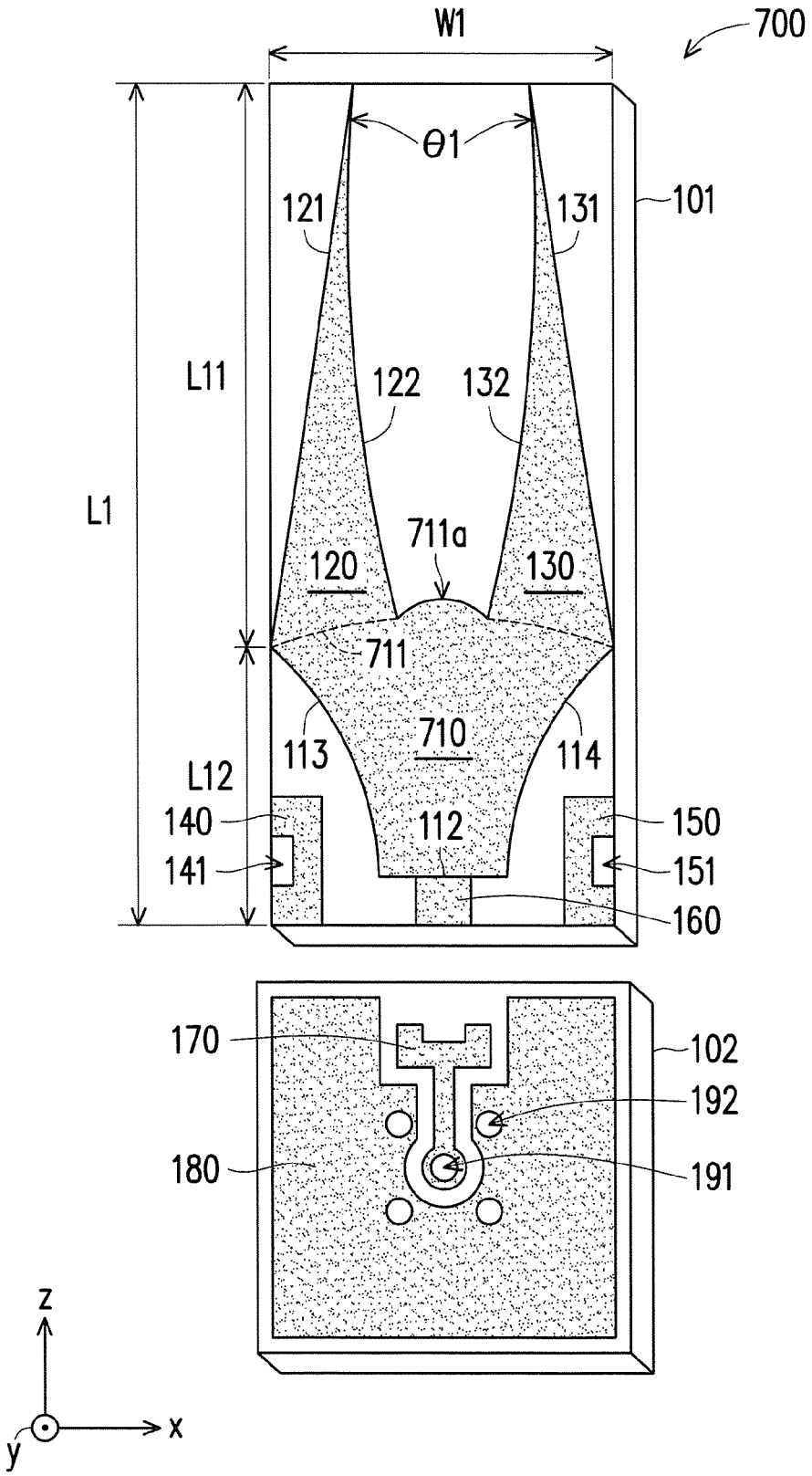
FIG. 7 is a schematic diagram illustrating a structure of a wideband antenna according to another exemplary embodiment.

For example, FIG. 7 is a schematic diagram illustrating a structure of a wideband antenna according to another exemplary embodiment, wherein a wideband antenna 700 shown in FIG. 7 is substantially similar to the wideband antenna 100 shown in FIG. 1. The main difference between the two embodiments is that the top side 111 of the radiation element 110 in FIG. 1 is shaped as a smooth arc, and a top side 711 of the radiation element 710 in FIG. 7 includes a middle section 711*a*. Specifically, the middle section 711*a* is located between the first extension element 120 and the second extension element 130. Furthermore, the middle section 711*a* protrudes outwardly, and the middle section 711*a* has an arc shape. In another embodiment, the middle section 711*a* may have a triangular shape, a curved shape, or an arbitrary geometric shape, for example. Thus, the directivity of the wideband antenna 700 operated in the first band can be adjusted through the middle section. Since the detailed structure of the wideband antenna 700 has been described in the above embodiments, it is not further explained hereinafter.

In summary, according to an embodiment, the wideband antenna has a radiation element which the width increases along the reference direction, and two extension elements extend from two opposite ends of the top edge. The widths of the two extension elements decrease along the reference direction. Furthermore, the two reflection elements are respectively disposed on the two sides of the radiation element. Thereby, the wideband antenna may have the characteristics of wideband and the advantages of miniaturization. Particularly, the wideband antenna has the wide bandwidth and great directivity when the wideband antenna is operated in the first band. Accordingly, the wideband antenna may by used as the calibration antenna in the small shield room and may also be applied to various kind of mobile communication devices.

It will be apparent to those skilled in the art that various modifications and variations can be made to the structure of the disclosed embodiments without departing from the scope or spirit of the invention. In view of the foregoing, it is intended that the invention cover modifications and variations of this invention provided they fall within the scope of the following claims and their equivalents.

What is claimed is:

1. A wideband antenna comprising:

a radiation element symmetric to a reference direction, the radiation element having a top edge, a bottom edge, a first side edge, and a second side edge, wherein a width of the radiation element increases along the reference direction;

a first extension element and a second extension element respectively extending toward the reference direction from two ends of the top edge, the first extension element and the second extension element being mirror-symmetric to each other with respect to the reference direction, wherein a first bevel edge and a second bevel edge of the first extension element intersect with each other to form a first open end, a third bevel edge and a fourth bevel edge of the second extension element intersect with each other to form a second open end, widths of the first extension element and the second extension element smoothly and gradually decrease along the reference direction, and a length of the top edge is greater than a distance between the first open end and the second open end;

a first reflection element and a second reflection element respectively opposite to the first side edge and the second side edge, the first reflection element and the second reflection element being mirror-symmetric to each other with respect to the reference direction, wherein the first reflection element and the second reflection element reflect electromagnetic energy radiated by the radiation element; and a feeding element connected to the bottom edge, the feeding element having a feeding point.

2. The wideband antenna of claim 1, wherein the first bevel edge and the second bevel edge define the width of the first extension element.

3. The wideband antenna of claim 1, wherein the third bevel edge and the fourth bevel edge define the width of the second extension element, and an intersection of an extension direction of the second bevel edge and an extension direction of the fourth bevel edge forms an angle.

4. The wideband antenna of claim 3, wherein the first bevel edge and the third bevel edge have a linear shape, and the second bevel edge and the fourth bevel edge have an arc shape.

5. The wideband antenna of claim 1, wherein the first side edge and the second side edge are inwardly concave and define the width of the radiation element.

6. The wideband antenna of claim 1, wherein the top edge of the radiation element comprising a middle section between the first and the second extension elements, the middle section protruding outwardly.

7. The wideband antenna of claim 1, wherein each of the first reflection element and the second reflection element has a notch, respectively.

8. The wideband antenna of claim 1, wherein each of the first reflection element and the second reflection element is shaped as a rectangle, a square, or an ellipse.

9. The wideband antenna of claim 1, wherein the wideband antenna is operated in a first band through a plurality of current paths formed by the radiation elements and extends a part of the current paths through the first extension element and the second extension element so as to be operated in a second band.

10. The wideband antenna of claim 9, wherein a total width of the wideband antenna is a quarter wavelength of a maximum frequency of the first band.

11. The wideband antenna of claim 9, wherein a total length of the wideband antenna is a quarter wavelength of a minimum frequency of the first band.

12. The wideband antenna of claim 1, wherein the wideband antenna is a monopole antenna.

13. The wideband antenna of claim 1, further comprising a first substrate, wherein the radiation element, the first extension element and the second extension element, the first reflection element and the second reflection element, and the feeding element are located on a surface of the first substrate.

14. The wideband antenna of claim 13, further comprising a second substrate, wherein the second substrate is perpendicular or parallel to the first substrate, the second substrate has a signal line and a ground plane on one surface of the second substrate, the signal line is electrically connected to the feeding element, and the ground plane is electrically connected to the first reflection element and the second reflection element.

15. The wideband antenna of claim 14, further comprising an antenna connector located on the other surface of the second substrate, wherein a signal pin of the antenna connector is electrically connected to the signal line, and a plurality of positioning pins of the antenna connector are electrically connected to the ground plane.

* * * * *